United States Patent [19]

Koshi et al.

[11] Patent Number: 4,761,312

[45] Date of Patent: Aug. 2, 1988

[54] WATERPROOF, UNEVENLY TEXTURED COATING FILM

[75] Inventors: Taro Koshi; Hidetoshi Kondo, both of Chiba, Japan

[73] Assignee: Dow Corning Corporation, Midland, Mich.

[21] Appl. No.: 54,452

[22] Filed: May 26, 1987

[30] Foreign Application Priority Data

Jun. 5, 1986 [JP] Japan ..... 61-130950

[51] Int. Cl.[4] ..... B05D 1/36; B05D 3/02

[52] U.S. Cl. ..... 427/387; 427/393.6; 427/407.1

[58] Field of Search ..... 427/265, 387, 258, 393.6, 427/407.1

[56] References Cited

U.S. PATENT DOCUMENTS 3,499,870 3/1970 Hadock et al. .
4,267,297 5/1981 Hanada et al. .
4,496,687 1/1985 Okada et al. .
4,572,917 2/1986 Graiver et al. .

*Primary Examiner*—Bernard D. Pianalto
*Attorney, Agent, or Firm*—Edward C. Elliott

[57] ABSTRACT

A method of forming a very durable, waterproof, and unevenly textured coating film on the wall surfaces of a structure comprises an undercoating material consisting of a silicone-modified organic resin, an uneven textured intermediate coating material consisting of a short fiber-containing aqueous silicone emulsion which forms a rubbery elastomer by means of removal of the water, and a top coating material consisting of a silicone-type resin.

8 Claims, No Drawings

WATERPROOF, UNEVENLY TEXTURED COATING FILM

BACKGROUND OF THE INVENTION

1. Field of the Invention

The present invention relates to a method for forming a very durable, waterproof and unevenly textured coating film on the wall surfaces of structures.

2. Background Information

It is known that compositions which consist of an acrylic resin or urethane resin aqueous emulsion, inorganic filler and short fiber are useful as coating materials which can be sprayed and cured on the interior and exterior wall surfaces of buildings to form waterproof coating films while simultaneously providing an uneven texture (for example, Jap. Pat. Appln. Laid Open Nos. 50-13426 [13,426/75], 50-65533 [65,533/75], Jap. Pat. Publication No. 54-32651 [32,651/79], and Jap. Pat. Appln. Laid Open No. 50-133235 [133,235/75]).

U.S. Pat. No. 4,496,687, issued Jan. 29, 1985, teaches a siloxane containing emulsion which can give an elastomer upon removal of water. The composition is stated as useful as a coating composition, fiber treating agent, binder for inorganic material and the like.

U.S. Pat. No. 4,572,917, issued Feb. 25, 1986, teaches a method of manufacturing a fiber reinforced silicone foam. An aqueous silicone emulsion is combined with inorganic fibers and frothed.

Silicone resins which cure at room temperature are taught in U.S. Pat. No. 3,499,870, issued Mar. 10, 1970. A hydroxyl containing methylphenylpolysiloxane resin, a hydroxylated dimethylpolysiloxane fluid, methyltriacetoxysilane and tin catalyst are combined to give the composition.

Room temperature curing resins are also taught in U.S. Pat. No. 4,267,297, issued May 12, 1981. An improved resin contains hydroxylated organopolysiloxane, an alkoxylated organopolysiloxane, an alkoxysilane, an aminoalkylalkoxysilane, and a tin catalyst.

However, while coating films can be formed by the curing of coating materials composed of acrylic resin or urethane resin, the weather resistance of such coating films is inadequate, and their properties are gradually degraded by long-term exposure to ultraviolet radiation and their elasticity is lost as a consequence. As a result, the cured coating film will crack, which spoils its aesthetics as a coating material. In particular, rain will penetrate through the cracks to reach the interior of the building, thus raising the problem of rain leakage. Also, these types of coating films have very low elongations at low temperatures, and so cannot be used in regions of cold.

The inventors carried out investigations in order to eliminate the aforesaid problems, and the present invention was developed as a consequence.

SUMMARY OF THE INVENTION

In the present invention, an undercoating material composed of a silicone-modified organic resin is applied to the wall surface of a structure to afford a cured film. To this is applied, in an uneven texture, an intermediate coating material composed of a short fiber-containing aqueous silicone emulsion which forms a rubbery elastomer by means of the removal of water. After curing of the intermediate coating material, a top coating material composed of a silicone-type resin is applied over the intermediate coating material. As a consequence of this method, the invention characteristically is a highly productive coating method for the formation of a very durable waterproof coating on the wall surfaces of structures, while simultaneously providing an uneven texture.

An object of the present invention is to provide a method which will produce a very durable, waterproof and unevenly textured coating film on the wall surfaces of structures.

DESCRIPTION OF THE INVENTION

This invention relates to a method of forming a waterproof, unevenly textured coating film on the wall surfaces of structures, which method comprises, (I) the formation of a cured film on the wall surface of a structure by application of undercoating material consisting of silicone-modified organic resin, (II) the subsequent application on the undercoating material of (I), in an uneven texture, of an intermediate coating material consisting of short fiber-containing aqueous silicone emulsion which will form a rubbery elastomer by means of the removal of the water fraction, followed by curing, and (III) the subsequent formation on the cured, intermediate coating material of (II) of a cured film by application of a top coating material consisting of silicone-type resin.

By way of explanation of the preceding, the undercoating material used in the present invention, in step (I), which is to consist of silicone-modified organic resin, functions to fill and thus smooth over the pores in any porous surface, for example, of concrete or mortar, etc., of the wall surface of the structure, while simultaneously functioning to promote adhesion to the structure's wall surface by the waterproof coating consisting of the aqueous silicone emulsion which comprises the intermediate coating material. The herein specified silicone-modified organic resin consists of the reaction product of silane or silicone resin with typical organic monomers or organic resins. These resins are concretely exemplified by silicone-modified organic resins in the form of the copolymers obtained by the radical reaction between vinyl monomer, for example, methyl methacrylate, styrene, etc., and silane coupling agent having an unsaturated hydrocarbon group, for example, gamma-methacryloxypropyltrimethoxysilane, vinyltrimethoxysilane; by the silicone-modified organic resins obtained by a condensation reaction between methyltrimethoxysilane and epoxy resin; and by the products of condensation between epoxy resins and gamma-glycidoxypropyltrimethoxysilane and/or N-(beta-aminoethyl)-gamma-aminopropyltrimethoxysilane. To obtain good adhesiveness, it is preferred that the silicone-modified organic resin contain a silicon-bonded hydrolyzable group, for example, an alkoxy group, in the molecule. When such a silicone-modified organic resin is used as the undercoating material, the workability must be taken into consideration. Accordingly, the aforementioned silicone-modified organic resin may be diluted as appropriate with a suitable solvent, for example, toluene, xylene, isopropanol, n-butanol, methyl ethyl ketone, ethyl acetate, etc., unless this adversely affects the object of the invention.

The undercoating material to be used in the invention preferably has a viscosity in the range of 5 to 300 cP, and more preferably in the range of 5 to 50 cP. At below 5 cP, infiltration into porous surfaces of the structure's wall surface will occur, and filling and smoothing over of the pores will thus not be possible. On the other hand, when the viscosity of the undercoating material exceeds 300 cP, its workability as an undercoating material is so reduced that its practical application becomes problematic. Furthermore, the solids fraction in said undercoating material is preferably in the range of 5 wt. % to 50 wt. %, and more preferably in the range of 10 wt. % to 40 wt. %. At below 5 wt. %, the pores in any porous surface of the structure's wall surface may not be filled and smoothed over. When 40 wt. % is exceeded, coating will be uneven and a uniform cured film will not be formed.

The intermediate coating material to be used in the present invention, in step (II), is a short fiber-containing aqueous silicone emulsion which will form a rubbery elastomer by means of the removal of the water fraction. This is typified by aqueous emulsion compositions which consist of the following: (A) an aqueous silicone emulsion which forms a rubbery elastomer by means of the removal of the water fraction, (B) inorganic filler, and (C) short fiber. Component (A) is an aqueous silicone emulsion which has the ability to form a rubbery elastomeric film coating by means of the removal of the water fraction, and those known in the art can be employed. Component (A) is exemplified by compositions of hydroxyl group-containing silicone polymer emulsion, colloidal silica, and organotin catalyst (for example, Jap. Pat. Appln. Laid Open No. 56-16553 [16,553/81], equivalent to U.S. Pat. No. 4,221,688, issued Sept. 9, 1980); by compositions of vinyl group-containing silicone polymer emulsion, SiH-containing silicone polymer emulsion, and platinum catalyst (for example, Jap. Pat. Appln. Laid Open No. 56-36546 [36,546/81], equivalent to U.S. Pat. No. 4,248,751, issued Feb. 3, 1981); by the material obtained by the emulsion polymerization of siloxane cyclics and organofunctional alkoxysilanes (for example, Jap. Pat. Publication No. 56-38609 [38,609/81], equivalent to U.S. Pat. No. 4,228,054, issued Oct. 14, 1980); and by compositions of hydroxyl-group containing silicone polymer emulsion, hydrolyzable silane, and curing catalyst (for example, Jap. Pat. Publication No. 59-36677 [36,677/84], equivalent to U.S. Pat. No. 4,100,124, issued July 11, 1978).

Among these, compositions having the constituent components listed below are preferred for the present invention because they dry and cure rapidly at room temperature and because they have good storage stability as the single-package intermediate coating material.

That is, said preferred compositions are aqueous silicone emulsions composed of (i) essentially linear organopolysiloxane having at least 2 silicon-bonded hydroxyl groups in each molecule;

(ii) crosslinker for component (i), wherein said crosslinker is selected from among colloidal silica, alkali metal silicates, hydrolyzable silanes, and the partial hydrolysis condensation products of hydrolyzable silanes;

(iii) curing catalyst;

(iv) emulsifying agent; and (v) water.

The organopolysiloxane comprising component (i) is the component which forms a rubbery elastomer by means of crosslinking by component (ii). It is to be a silicone polymer having at least 2 silicon-bonded hydroxyl groups in each molecule. While the position of these hydroxyl groups is not specifically restricted, they are preferably present at both molecular terminals. The other silicon-bonded organic groups are to be unsubstituted and substituted monovalent hydrocarbon groups such as alkyl groups, for example, methyl, ethyl, propyl, and butyl; alkenyl groups, for example, vinyl and allyl; aryl groups, for example, phenyl; aralkyl groups, for example, benzyl; alkaryl groups, for example, styryl and tolyl; cycloalkyl groups, for example, cyclohexyl and cyclopentyl; and these groups in which all or part of the hydrogen atoms have been replaced by halogen, for example, fluorine, chlorine, and bromine, such as, for example, 3-chloropropyl and 3,3,3-trifluoropropyl. These monovalent organic groups are usually methyl, vinyl and phenyl, and in particular methyl, but they need not be identical and combinations of different monovalent hydrocarbon groups may be used. The molecular configuration is to be essentially linear, meaning linear or slightly branched linear. While the molecular weight is not specifically restricted, molecular weights 5,000 are preferred.

A reasonable tensile strength and elongation will be achieved at molecular weights 30,000, and the best values of tensile strength and elongation will be obtained at molecular weights 50,000. Concrete examples of this organopolysiloxane are hydroxyl-terminated dimethylpolysiloxanes, hydroxyl-terminated methylphenylpolysiloxanes, hydroxyl-terminated dimethylsiloxane-methylphenylsiloxane copolymers, hydroxyl-terminated methylvinylpolysiloxanes, and hydroxyl-terminated dimethylsiloxane-methylvinylsiloxane copolymers, etc. Such an organopolysiloxane can be synthesized, for example, by the ring-opening polymerization of organosiloxane cyclics; by the hydrolysis of linear or branched organopolysiloxane having hydrolyzable groups, for example, the alkoxy or acyloxy groups; and by the hydrolysis of one or two or more species of diorganodihalosilanes, etc.

Component (ii) functions as the crosslinker for component (i). The colloidal silicas include fumed colloidal silica, precipitated colloidal silica, and colloidal silicas stabilized with sodium, ammonia or aluminum ions and having particle sizes of 0.0001~0.1 micrometers. The colloidal silica is to be used at 1~150 weight parts and preferably 1.0~70 weight parts per 100 weight parts organopolysiloxane comprising component (i).

The alkali metal silicate is preferably soluble in water and preferably is converted into its aqueous solution in advance of use. These alkali metal silicates encompass, for example, lithium silicate, sodium silicate, potassium silicate, and rubidium silicate. Its quantity of addition is to be 0.3~30 weight parts and preferably 0.3~20 weight parts per 100 weight parts organopolysiloxane comprising component (i).

The hydrolyzable silane or partial hydrolysis condensate thereof comprising component (ii) must have at least 3 silicon-bonded hydrolyzable groups per molecule because an elastomer cannot be obtained at less than 3. The hydrolyzable groups in this case are exemplified by alkoxy groups such as methoxy, ethoxy, and butoxy; acyloxy groups such as acetoxy; substituted and unsubstituted acetamido groups such as acetamido and N-methylacetamido; alkenyloxy groups such as propenoxy; substituted amino groups such as N,N-dimethylamino and N,N-diethylamino; and ketoxime groups such as methyl ethyl ketoxime. Component (ii) is exemplified by methyltrimethoxysilane, vinyltrimethoxysilane, n-propyl orthosilicate, ethyl polysilicate, and propyl polysilicate. With regard to use, mixtures of 2 or more species can be used without any problem. The blending quantity is generally 0.1~15 weight parts per 100 weight parts organopolysiloxane comprising component (i).

The curing catalyst comprising component (iii) promotes the condensation reaction between component (i) and component (ii), and an exemplary list encompasses the metal salts of organic acids, for example, dibutyltin dilaurate, dibutyltin diacetate, tin octenoate, dibutyltin dioctate, tin laurate, ferric stannooctenoate, lead octenoate, lead laurate and zinc octenoate; titanate esters such as tetrabutyl titanate, tetrapropyl titanate, and dibutoxytitanium bis(ethyl acetoacetate); and amine compounds such as n-hexylamine and guanidine and their hydrochlorides. Furthermore, it is preferred that the curing catalyst be converted in advance into an emulsion using an emulsifying agent and water.

Component (iii) is generally added at 0.01~1.5 weight parts and preferably 0.05~1 weight parts per 100 weight parts organopolysiloxane comprising component (i).

The emulsifying agent comprising component (iv) functions to emulsify mainly component (i), and encompasses the anionic, nonionic and cationic emulsifying agents. Examples of the anionic emulsifying agents are the salts of higher fatty acids, the salts of the sulfate esters of higher alcohols, alkylbenzenesulfonate salts, alkylnaphthalenesulfonate salts, alkylsulfones, and salts of the sulfate esters of polyethylene glycol. Examples of the nonionic emulsifying agents are polyoxyethylene alkylphenyl ethers, sorbitan fatty acid esters, polyoxyethylene sorbitan fatty acid esters, polyoxyalkylene fatty acid esters, polyoxyethylene-polyoxypropylenes, and fatty acid monoglycerides. Examples of the cationic emulsifying agents are aliphatic amines, quaternary ammonium salts, and alkylpyridinium salts. These emulsifying agents may be used singly or two or more may be used. The quantity of use is generally 0.2~30 weight parts per 100 weight parts organopolysiloxane comprising component (i).

The water comprising component (v) is not specifically restricted, and is to be used in a quantity sufficient to emulsify components (i)~(iii) under the activity of component (iv).

The inorganic filler comprising component (B) acts, in particular in its combination with the component (C) to be discussed below, to adjust the fluidity and viscosity of the intermediate coating material to levels suitable for obtaining an uneven texture. Examples of inorganic filler are calcium carbonate, clay, aluminum oxide, aluminum hydroxide, finely powdered silica, mica, titanium dioxide, zinc oxide, and barium sulfate.

The average particle size of this inorganic filler is preferably 10 microns, and it is to be blended at 10 to 200 weight parts and preferably 40 to 120 weight parts per 100 weight parts component (A).

The short fiber comprising component (C) is essential for making the intermediate coating material suitable for execution in an uneven texture, while at the same time imparting a suitable fluidity, and thus a good workability, to the intermediate coating material. Its quantity of addition is to be 0.1 to 50 weight parts and preferably 0.3 to 10 weight parts per 100 weight parts component (A). It is difficult to obtain an uneven texture at below 0.1 weight part. On the other hand, when 50 weight parts is exceeded, the workability is reduced, and the short fiber itself will appear in the cured coating film, undesirably generating a fibrous pattern. Said short fiber can be a synthetic or natural short fiber or powdery short fiber, and it is exemplified by asbestos, rock wool, pulp, glass wool, slag wool, nylon fiber, polyester fiber, acrylic fiber, rayon, polyvinyl chloride, polypropylene, vinylon, silk, flax, cotton, and wool. Of these, cellulosic fibers such as rayon and pulp are preferred. Depending on the object, a dispersant is optionally also added to the intermediate coating material. This dispersant acts to disperse the filler particles uniformly, to prevent the aggregative collapse of the emulsion particles either when component (B) and/or component (C) is added to the aqueous silicone emulsion comprising component (A), or during mixing after said addition, and to prevent the appearance of an insoluble component. This is generally known as a protective colloid, and actual examples are polyphosphate salts such as sodium tripolyphosphate, sodium tetraphosphate, sodium hexametaphosphate, sodium polymetaphosphate, and sodium tetrapolyphosphate, etc.; the formalin condensates of sodium alkylnaphthalenesulfonates; low molecular weight ammonium polyacrylates; low molecular weight copolymers of styrene and ammonium maleate; casein; sodium ligninsulfonate; polyvinyl alcohol; sodium polyacrylates; poly(vinylpyrrolidone); glycidyl methacrylate; and cellulose derivatives such as methylcellulose, hydroxyethylcellulose, and carboxymethylcellulose. Of these, sodium polyacrylates, glycidyl methacrylate, and sodium tetrapolyphosphate are particularly effective. In order to accomplish the object, this component should be added and dissolved into the aqueous silicone emulsion in advance of filler addition. Alternatively, the object can be accomplished by treating the surface of component (B) and/or component (C) with the dispersant in advance of the addition of said components. The methods for treating components (B) and (C) with dispersant are roughly classified into dry methods and wet methods. A preferred aqueous silicone emulsion, which avoids the problems of aggregative collapse of the emulsion particles, poor dispersion of components (B) and (C) and the appearance of an insoluble fraction, will be obtained using any such method which results in the surfaces of components (B) and (C) being uniformly and thoroughly coated with dispersant molecules.

Sodium polyacrylate, glycidyl methacrylate and sodium tetrapolyphosphate are particularly preferred as dispersants for use in such surface treatments.

Depending on the object, a consistency-adjusting agent may optionally be added to the intermediate coating material used in the present invention. In addition to sizes such as carboxymethylcellulose, methylcellulose, hydroxyethylcellulose and polyvinyl alcohol, acrylic emulsion thickeners may also be used as the consistency-adjusting agent. The quantity of addition here is to be approximately 0.01 to 1.0 weight percent. At below 0.01 weight percent, the viscosity will be too low, and difficulties may be encountered in the formation of an uneven texture. At larger quantities, the fluidity is so reduced that the surface of the coating film will not smooth out, and a smooth finish becomes impossible due to residual craters and pinholes and residual small patterns on the surface of the uneven texture. Spraying from a spray gun may become impossible with further increases in the viscosity.

The intermediate coating material to be used in the present invention can be produced, for example, as follows. The silicone aqueous emulsion comprising component (A) is prepared from the aforementioned components (i) to (v). This can be done by the various methods known in the art. For example, hydroxyl-terminated polydimethylsiloxane, etc. (component (i)) is emulsified in water (component (v)) using the emulsifying agent (component (iv)) and an emulsifying device such as a homomixer, homogenizer, colloid mill, etc., and this is followed by the addition and mixing of the colloidal silica, alkali metal silicate, hydrolyzable silane or partial hydrolysis condensate thereof (component (ii)) and the curing catalyst (component (iii)). Alternatively, organopolysiloxane cyclics, for example, octamethyltetrasiloxane, are emulsified in water using an emulsifying agent, a ring-opening polymerization catalyst is added, and polymerization is then carried out with heating in order to produce an emulsion of hydroxyl-terminated diorganopolysiloxane. To this is then added the colloidal silica, alkali metal silicate, hydrolyzable silane, or partial hydrolysis condensate thereof comprising component (ii) and the curing catalyst comprising component (iii). These methods are not specifically restricted, and, for example, a base emulsion composition may be prepared which consists of 100 weight parts hydroxyl-containing organopolysiloxane (component (i)); 1 to 150 weight parts colloidal silica, 0.3 to 30 weight parts alkali metal silicate or 0.1 to 15 weight parts hydrolyzable silane or partial hydrolysis condensate thereof (component (ii)); a catalytic quantity of the curing catalyst (component (iii)); 0.2 to 30 weight parts emulsifying agent (component (iv)); and water (component (v)). The pH of the base emulsion is then adjusted to 9 to 12, for example, by the addition of an amine such as diethylamine or ethylenediamine, etc., or an alkali metal hydroxide such as sodium hydroxide or potassium hydroxide, etc. Organic amine is preferred as the adjustment agent. Further examples of organic amines are monoethanolamine, triethanolamine, morpholine and 2-amino-2-methyl-1-propanol. This is then ripened for a specified period of time. The ripening temperature is to be a temperature at which the emulsion is not destroyed, that is, 10° to 95° C. and preferably 15° to 50° C. The ripening period corresponds to the period necessary for the base emulsion composition to acquire the property of forming an elastomeric material by means of the removal of water from the base emulsion composition. In concrete terms, it will be a week or more at 25° C. or 4 or more days at 40° C.

Next, the consistency agent and dispersant, and then components (B) and (C), are added with mixing. Alternatively, after the addition of the consistency agent, components (B) and (C), in this case having surfaces treated in advance with dispersant, are added with mixing.

Those components typically added and blended into water-base paints, for example, defoamers, pigments, dyes, preservatives, penetrants (ammonia, etc.), may be added and blended into the intermediate coating material of the present invention.

The top coating material used in the present invention in step (III) has the function of preventing the soiling of the waterproof coating film formed by the method of the present invention, and also imparts gloss and durability to this coating film. This top coating material is to have as its principal component a silicone-type resin, and concrete examples here are the silicone resins known in the art (for example, refer to Jap. Pat. Appln. Laid Open No. 55-48245 [48245/80]), and solutions and emulsions of alkyd-modified or acrylic-modified resins based on them. Silicone resins which cure at room temperature and are useful in this invention are taught in U.S. Pat. No. 3,499,870, issued Mar. 10, 1970, and 4,267,297, issued May 12, 1981, both patents being incorporated by reference to show silicone resins and methods of their manufacture.

Preferred resins are based upon a hydroxyl containing organopolysiloxane resin, such as is produced by hydrolysis of one or a mixture of two or more chlorosilanes having 0.8 to 1.8 organic radicals per silicon atom. The preferred organic radicals are methyl and phenyl radicals. The resin can also contain silicon functional groups which react with water to produce hydroxyl groups, such as alkoxy groups. A preferred resin contains an alkoxylated organopolysiloxane, an alkoxysilane, an aminoalkylalkoxysilane, and a tin salt as a catalyst.

The successive application, drying and curing on a structure's wall surface of the undercoating material, intermediate coating material and top coating material will be discussed in the following.

The undercoating material of the present invention can be applied by those application methods typically used for primers, for example, by brush coating, spray coating, roller coating, etc. The quantity of application will vary depending on the solids fraction and specific gravity of the undercoating material, but is suitably approximately 0.1 to 0.2 kg/m$^2$.

The intermediate coating material of the present invention is to be sprayed on the wall surface of the structure using a spray gun such as, for example, a tile gun or stucco gun, followed by standing as is to dry and cure.

The intermediate coating material can be directly sprayed on the aforementioned undercoating material in an uneven texture, for example, a stucco texture or a sprayed-bead texture. However, from the standpoint of imparting waterproofness to the overall coating film, it is preferred, in order to achieve the formation of a better waterproof coating film, that the intermediate coating material of the present invention be first sprayed with a spray gun in a uniform thickness, to form a waterproof layer. The intermediate coating material of the present invention is then sprayed a second time, over the aforementioned waterproof layer, in an uneven texture, for example, a sprayed-bead texture or stucco texture, followed again by drying and curing. While the thickness of the aforesaid waterproof layer of intermediate coating material is not specifically restricted, it should be an approximately 1 mm thick coating film from a consideration of the waterproofness. While the quantities of application of the waterproof layer and textured layer of intermediate coating material will depend on the specific gravity and solids fraction of the intermediate coating material, these values may be given as approximately 1.5 to 2.0 kg/m$^2$ and 0.3 to 0.7 kg/m$^2$, respectively.

With regard to the method for applying the top coating material of the present invention, it is to be applied after the intermediate coating material has dried and cured, and is preferably sprayed using an air or airless gun in order to provide a uniform application. The film thickness of the top coating material after drying is not specifically restricted, but the quantity of application is preferably about 0.1 kg/m$^2$.

The method of the present invention provides the means for the formation, on the wall surfaces of structures, of a very durable, waterproof coating film having an uneven texture.

The following examples are included for illustrative purposes only and should not be construed as limiting the invention, which is properly set forth in the appended claims. In the examples, parts equal weight parts, and the viscosity is the value measured at 25° C.

EXAMPLE 1

An undercoating material was prepared as follows. A mixture of 20 parts gamma-methacryloxypropyltrimethoxysilane, 80 parts methyl methacrylate, 100 parts xylene, and 1.0 part azobisisobutyronitrile was mixed and then heated at 100° C. for 3 hours to give gamma-methacryloxypropyltrimethoxysilane-methyl methacrylate copolymer. Xylene was added to this copolymer to prepare an undercoating material having 40 percent solids and a viscosity of 150 cP.

An intermediate coating material was prepared as follows. A mixture of two parts sodium laurate and 70 parts water was mixed into 100 parts hydroxyl-terminated dimethylpolysiloxane having 30 siloxane repeat units, this mixture was passed twice through an homogenizer at 300 kg/cm$^2$, 1 part dodecylbenzenesulfonic acid was then added as polymerization initiator, and this was then emulsion polymerized at room temperature for 10 hours. The pH was then adjusted to 7 using aqueous sodium hydroxide to afford an emulsion containing hydroxyl-terminated dimethylpolysiloxane having a molecular weight of approximately 200,000 (designated below as dimethylpolysiloxane emulsion I). Five parts colloidal silica, 3.5 parts 2-amino-2-methyl-1-propanol and 0.1 part dioctyltin dilaurate were added to 100 parts of this emulsion I, and this mixture was allowed to stand for 7 days to afford an aqueous silicone emulsion latex having 55 weight percent solids. Two parts short vinylon fiber (length=2.0 mm) and 120 parts suspensible calcium carbonate were blended and mixed into 182 parts of this emulsion.

As the top coating material, a toluene solution (20 weight percent solids, viscosity=10 cP) of a room temperature-curable silicone resin was prepared.

The undercoating material was uniformly applied by spraying (air gun) in an application quantity of 0.1 kg/m$^2$ on a vertical mortar surface, followed by drying at room temperature for 1 hour. The aforementioned intermediate coating material was then filled into a spray gun from Iwata Tosoki Kogyo Kabushiki Kaisha, sprayed uniformly under an air pressure of 4 to 5 kg/cm$^2$, and then dried at room temperature to afford a waterproof layer with a coating film thickness of 1 mm. The aforementioned intermediate coating material was then again sprayed as beads in a quantity of application of 0.5 kg/m$^2$ to form an uneven texture, followed by standing for 1 day. On the next day, after confirming that the intermediate coating material has dried and cured, the top coating material was uniformly applied at 0.1 kg/m$^2$ using an air gun. Drying at room temperature for 2 to 3 hours provided a lustrous and very durable waterproof film having an uneven texture. The waterproof coating obtained as above was evaluated according to JIS A-6910 (multilayer finish), and the results are reported in Table 1.

TABLE 1

| item measured | standard | observed value |
|---|---|---|
| low-temperature stability | no lumps, separation, or aggregation | pass |
| initial cracking | no cracking | pass |

TABLE 1-continued

| item measured | standard | observed value |
|---|---|---|
| resistance | | |
| bonding strength in kg/cm$^2$ | | |
| normal | greater than 7.0 | 10.2 |
| after immersion in water | greater than 5.0 | 7.2 |
| hot/cold cycle resistance | no peeling, swelling, or cracking | pass |
| water permeability (mL) | greater than 0.5 | 0.05 |
| impact resistance | no peeling, cracking, or deformation | pass |
| weather resistance | no peeling, cracking, or discoloration | pass |
| extensibility, elongation (%) | | |
| 20° C. | greater than 120 | 340 |
| −10° C. | greater than 20 | 330 |
| after immersion in water | greater than 100 | 270 |
| after heating | greater than 100 | 280 |
| change during elongation | no peeling, scission, or cracking | pass |

EXAMPLE 2

An undercoating material was prepared as follows. First, 70 parts methyltrimethoxysilane, 30 parts epoxy resin (Epikote 1001 from Shell Chemical Co.) and 0.1 part tetrabutyl titanate were placed in a three-neck flask and then condensation reacted with the liberation of methanol at 90° C. with stirring to give a methyltrimethoxysilane-epoxy resin condensate. Then 10 parts tetrabutoxytitanate was added to 100 the condensate to prepare the undercoating material (40 percent solids, viscosity of 10 cP).

An intermediate coating material was prepared as follows. First, 1 part vinyltrimethoxysilane and 0.1 part dioctyltin dilaurate catalyst were mixed into 100 parts of the dimethylpolysiloxane emulsion I prepared as in Example 1 to afford an aqueous silicone emulsion.

Then, 1 part short rayon fiber (length of 2.0 mm, 100 parts suspensible calcium carbonate and 0.2 parts sodium polyacrylate as consistency agent were blended and mixed into 182 parts of this emulsion.

An ivory colored colorant of an aqueous silicone emulsion SE1980 from Toray Silicone Co., Ltd., was added.

The top coating material was a mineral spirits solution (viscosity of 200 cP, 50 weight percent solids) of a room temperature-curable alkyd-modified silicone resin.

The undercoating material was uniformly applied by spraying at 0.1 kg/m$^2$ onto a vertical mortar surface, and then drying at room temperature for 1 hour. The intermediate coating material was filled into a spray gun from Iwata Tosoki Kogyo KK, sprayed uniformly at an air pressure of 4 to 5 kg/cm$^2$, and dried at room temperature for 2 to 3 hours to provide a waterproof layer having a coating film thickness of 1 mm. Onto this was then again sprayed the intermediate coating material as the bead at a coating quantity of 0.5 kg/m$^2$ to form an uneven texture, followed by drying for 2 to 3 hours. Aqueous silicone emulsion SE1980 (ivory color) from Toray Silicone Co., Ltd., was uniformly applied as colorant at an application quantity of 0.5 kg/m$^2$ using an airless gun. The result was a wall surface having an ivory-colored, uneven texture. After standing for 1 day, it was uniformly sprayed with the aforesaid top coating material at an application quantity of 0.1 kg/m$^2$ using an air gun, followed by drying for 2 to 3 hours. A lustrous, waterproof coating having an uneven texture was produced. This waterproof coating was evaluated in accordance with JIS A-6910 (multilayer finish), and the results are reported in Table 2.

TABLE 2

| item measured | standard | observed value |
|---|---|---|
| low-temperature stability | no lumps, separation, or aggregation | pass |
| initial cracking resistance | no cracking | pass |
| bonding strength in kg/cm$^2$ | | |
| normal | greater than 7.0 | 9.3 |
| after immersion in water | greater than 5.0 | 6.5 |
| hot/cold cycle resistance | no peeling, swelling, or cracking | pass |
| water permeability (mL) | greater than 0.5 | 0.04 |
| impact resistance | no peeling, cracking, or deformation | pass |
| weather resistance | no peeling, cracking, or discoloration | pass |
| extensibility, elongation (%) | | |
| 20° C. | greater than 120 | 350 |
| −10° C. | greater than 20 | 340 |
| after immersion in water | greater than 100 | 290 |
| after heating | greater than 100 | 310 |
| change during elongation | no peeling, scission, or cracking | pass |

That which is claimed is:

1. A method of forming a waterproof, unevenly textured coating film on the wall surfaces of structures, which method comprises, (I) the formation of a cured film on the wall surface of a structure by application of an undercoating material consisting of a silicone-modified organic resin, (II) the subsequent application on the undercoating material of (I), in an uneven texture, of an intermediate coating material consisting of short fiber-containing aqueous silicone emulsion which will form a rubbery elastomer by means of the removal of the water fraction, followed by curing, and (III) the subsequent formation on the cured, intermediate coating material of a (II) a cured film by application of a top coating material consisting of a silicone-type resin.

2. The method described in claim 1, wherein the undercoating material is a silane-modified organic resin having a viscosity and a solids fraction suitable for filling the pores of porous surfaces of wall surfaces of structures.

3. The method described in claim 1, wherein the intermediate coating material is a composition which consists of (A) an aqueous silicone emulsion which forms a rubbery elastomer by means of the removal of the water fraction, (B) inorganic filler, and (C) short fiber.

4. The method described in claim 1, wherein the top coating material is a room temperature-curable silicone resin.

5. The method described in claim 1, wherein the top coating material is a room temperature-curable alkyd-modified silicone resin.

6. The method of claim 2 wherein the silane-modified organic resin has a viscosity of from 5 to 50 centipoise and a solids fraction in the range of 10 to 40 weight percent.

7. The method of claim 3 wherein the aqueous silicone emulsion is composed of (i) essentially linear organopolysiloxane having at least 2 silicon-bonded hydroxyl groups in each molecule, (ii) crosslinker for component (i), wherein said crosslinker is selected from among colloidal silica, alkali metal silicates, hydrolyzable silanes, and the partial hydrolysis condensation products of hydrolyzable silanes; (iii) curing catalyst, (iv) emulsifying agent, and (v) water; the inorganic filler is present in the range of 40 to 120 weight parts based upon 100 weight parts of component (A); and the short fiber is present in the range of 0.3 to 10 weight parts.

8. The method of claim 1 in which the undercoating material is applied at a rate of from 0.1 to 0.2 kilograms per square meter, the intermediate coating material is applied at a rate of 1.5 to 2.0 kilograms per square meter, and the top coat is applied at about 0.1 kilograms per square meter.

* * * * *

UNITED STATES PATENT AND TRADEMARK OFFICE

CERTIFICATE OF CORRECTION

PATENT NO. : 4,761,312

DATED : August 2, 1988

INVENTOR(S) : Taro Koshi and Hidetoshi Kondo

It is certified that error appears in the above-identified patent and that said Letters Patent is hereby corrected as shown below: Title page:

at (73) Assignee: remove, "Dow Corning Corporation, Midland, Mich."

And replace with, "Toray Silicone Company, Ltd., Tokyo, Japan

Signed and Sealed this

Tenth Day of January, 1989

*Attest:*

*Attesting Officer*

DONALD J. QUIGG

*Commissioner of Patents and Trademarks*